US005118201A

United States Patent [19]

Cook

[11] Patent Number: 5,118,201

[45] Date of Patent: * Jun. 2, 1992

[54] BAG MOUTH CLOSURE STRUCTURE

[76] Inventor: Teel M. Cook, 726 Windsor Pkwy., Atlanta, Ga. 30342

[ * ] Notice: The portion of the term of this patent subsequent to Dec. 25, 2007 has been disclaimed.

[21] Appl. No.: 615,066

[22] Filed: Nov. 19, 1990

Related U.S. Application Data

[63] Continuation-in-part of Ser. No. 479,115, Feb. 13, 1990.

[51] Int. Cl.[5] ..... B65D 30/06

[52] U.S. Cl. ..... 383/12; 383/72; 383/74

[58] Field of Search ..... 383/12, 26, 33, 72, 383/73, 74, 75, 25, 28, 6, 7, 10, 34, 34.1, 71, 76

[56] References Cited

U.S. PATENT DOCUMENTS

| | | | |
|---|---|---|---|
| D. 254,221 | 2/1980 | Beekenkamp | D3/73 |
| D. 296,045 | 6/1988 | Holem | D3/73 |
| 597,395 | 1/1898 | De Kay | 383/74 |
| 735,560 | 8/1903 | Müller | 383/117 X |
| 1,095,790 | 5/1914 | Blumel | 383/73 X |
| 1,564,930 | 12/1925 | Boyes | 383/75 X |
| 2,043,782 | 6/1935 | Sprosty | 383/111 X |
| 2,066,062 | 12/1936 | Quisling | 383/25 |
| 2,348,964 | 5/1944 | Dodson | 383/6 X |
| 2,510,186 | 6/1950 | Marsico et al. | 383/72 X |
| 2,598,334 | 5/1952 | Ahlburg | 383/74 |
| 2,654,892 | 10/1953 | Szabo | 383/33 X |
| 2,765,833 | 10/1956 | Kwon | 383/73 X |
| 2,815,785 | 12/1957 | Vail | 383/75 X |
| 2,832,116 | 4/1958 | Clevett et al. | 383/74 X |
| 2,925,111 | 2/1960 | Satterfield | 383/72 X |

(List continued on next page.)

FOREIGN PATENT DOCUMENTS

| | | | |
|---|---|---|---|
| 240122 | 10/1911 | Fed. Rep. of Germany | 383/72 |
| 1115149 | 4/1956 | France | 383/117 |
| 1236831 | 6/1960 | France | 383/72 |
| 91438 | 11/1921 | Switzerland | 383/6 |
| 209927 | 8/1940 | Switzerland | 383/72 |

OTHER PUBLICATIONS

Mid-Atlantic Waste Systems; "Bag It"; 1988 Designed by Bob Bunn of The Bag Connection.

Lillian Vernon; "Welcome at Spring" (Catalog); 1990 Nylon Mesh Toy Storage Bags, p. 19.

Lillian Vernon; "Welcome at Spring" (Catalog); 1990 Bathtub Bag, p. 20.

Greenpeace; "The Greenpeace Catalog"; 1989, 1990 Rainbow Warrior Drawstring Totebag, p. 2.

Greenpeace; "The Greenpeace Catalog"; 1989, 1990 Greenpeace Shopping Bag, p. 11.

*Primary Examiner*—Stephen Marcus
*Assistant Examiner*—Jes F. Pascua

[57] ABSTRACT

A bag mouth closure structure having a semirigid drawstring comprising a handle and a flexible cord. The semirigid drawstring assists in holding the mouth of a bag open so that articles can be easily deposited. The handle is a substantially rigid tube that allows a bag to simultaneously hang and perform as an open mouth receptacle. A shoulder strap passes through the hollow handle and is fastened into a closed loop. The shoulder strap and handle are provided for carrying as well as suspending a bag. Some ways of attaching the bag mouth structure to the upper portion of a bag are here briefly described. The flexible string and the hollow handle may be encased in a hem at the top of a bag wall or within the fold at the top of a double-wall bag. Or the flexible string along may be encased within a hem or fold at the top of a bag and captured within the handle. A portion of the top edge containing the flexible string can be retained behind a longitudinal slot in the bottom of the handle to attach the bag to the mouth structure. When a mesh material is used to construct a bag employing a bag mouth structure of the present invention, the ends of the drawstring may pass through mesh openings to engage a drawstring retainer. Also the shoulder strap may exit a hem or fold at the top of the bag through mesh openings. Otherwise, reinforced openings may be provided for the drawstring ends and shoulder strap to pass through. Other ways of attaching a bag to the mouth structure are disclosed.

20 Claims, 2 Drawing Sheets

U.S. PATENT DOCUMENTS

| | | | |
|---|---|---|---|
| 3,013,597 | 12/1961 | Moran | 383/6 |
| 3,653,583 | 4/1972 | Meyer | 229/54 C |
| 3,826,296 | 7/1974 | Morris | 383/111 X |
| 4,004,722 | 1/1977 | Olivier | 224/45 P |
| 4,148,347 | 4/1979 | Seaman | 383/75 X |
| 4,174,416 | 11/1979 | Mercer | 428/107 |
| 4,445,230 | 4/1984 | Spadaro | 383/7 |
| 4,691,369 | 9/1987 | Costa | 383/17 |
| 4,694,503 | 9/1987 | Hydorn | 383/12 |
| 4,710,967 | 12/1987 | Petschner | 383/8 |
| 4,739,880 | 4/1988 | Sawyer et al. | 206/223 |
| 4,795,268 | 1/1989 | Jordá | 383/117 X |
| 4,846,519 | 7/1989 | Leonard | 294/171 |
| 4,932,790 | 6/1990 | Jordá | 383/74 |
| 4,974,709 | 12/1990 | Furlow et al. | 383/74 X |
| 4,979,833 | 12/1990 | Cook | 383/74 X |

BAG MOUTH CLOSURE STRUCTURE

This is a continuation-in-part of may U.S. Pat. application Ser. No. 07/479,115, filed Feb. 13, 1990 for a multiple use bag.

BACKGROUND—FIELD OF INVENTION

This invention pertains to bag mouth structures having a handle, a drawstring closure or a shoulder strap for use in shopping bags, tote bags or open mouth receptacles.

BACKGROUND—DESCRIPTION OF PRIOR ART

Retail stores generally dispense disposable paper or plastic bags. Because these bags are rarely reused, they pose a problem to the environment. They rapidly consume resources in their production, and they add to the excessive waste already overcrowding landfills. Although many of these bags can be recycled, the value of the recycled material is generally significantly less than the value of virgin material. Some advantages of these disposable bags are that they are inexpensive to produce and do not have to be maintained by the consumer for reuse. However, the cost to the environment may outweigh these advantages. A solution is to provide the consumer with a reusable shopping bag. Because a reusable shopping bag will most likely cost more to manufacture than disposable bags, it must have additional advantages that a consumer would consider worth paying for, such as a comfortable handle, a shoulder strap and a means of securing the bag's contents.

U.S. Pat. No. 4,148,347 shows a reusable shopping bag which incorporates durable materials and construction. The bag accommodates consumer needs by featuring and adjustable shoulder strap, handles and an adjustable girth which permits the pouch to be used in small and large item receiving capacities. As a reusable bag, it overcomes the disadvantages of the disposable shopping bag. However the complexity of its construction and the materials employed may lead to a higher manufacturing cost and added difficulty in maintenance. Another disadvantage to such bags is the use of "string-like" handles. Although a shoulder strap is provided, the user may choose to carry the bag by the handles. Because a string-like handle does not sufficiently spread the pressure applied to the hand by the weight of the bag, it is uncomfortable to hold.

U.S. Pat. No. 4,691,369 shows a bag whose soft braided or woven handles are the closed bail type and are designed to replace the less expensive string or cord handled shopping bags. Such bags with such soft braided or woven handles are very popular due to their comfort. They attach to a side gusseted paper bag, however. Disadvantages of this type of bag are that it is generally considered disposable, and no closure is provided to secure its contents. And although the handle is more comfortable than other bail handles, it can still cause discomfort because it wraps around and compresses the hand from the sides.

U.S. Pat. No. 4,846,519 shows an "elongated tubular body." The tube is slotted so that it can slip over the bail handle of a shopping bag and spread the pressure applied to the hand. A rigid tube with a sufficient diameter is more comfortable than even a soft mesh bail handle because the pressure is applied directly to the palm of the hand and not the sides of the hand. Although such a tube improves the use of existing shopping bags, a disadvantage is that it is a separate product that must be carried and manipulated by the user; a "band-aid" to the problem of uncomfortable handles.

Bags designed to perform as receptacles for laundry are also well known. U.S. Pat. No. 4,739,880 shows a bag supported by a removable rigid shell insert, which serves as an open-mouth receptacle. The advantage of such a bag is that the insert facilitates depositing laundry into the bag. A disadvantage is that the rigid shell insert requires additional manipulation and storage. This is an inconvenience to the user. Another disadvantage of such a bag is the omission of a handle or strap for carrying. Such bags also feature a drawstring closure. The advantages of a drawstring are that it consists of few and simple parts, is easy to produce and provides a satisfactory closure to the mouth of a flexible bag.

U.S. Pat. No. 4,694,503 shows a laundry receptacle bag. Such a bag features a drawstring combined with a detachable support for the mouth. The support is designed to hang from a doorknob or hook. The advantage of this design is that the bag functions as an open-mouth laundry receptacle without taking up any floor space. A disadvantage is that the bag must be removed from the rigid support to be closed via the drawstring. Also the storage and manipulation of the rigid frame is an inconvenience. Another disadvantage is that a handle or shoulder strap is not provided for carrying the bag when it is removed from the frame.

U.S. Pat. No. 1,564,930 shows a laundry bag provided with a drawstring closure, which is suspended from a hanger such as a coat hanger. A horizontal slot above the drawstring is provided to facilitate the deposit of laundry into the bag. The hanger is inserted through the horizontal slot for suspending the bag. An advantage of this design is that such a bag performs as an open mouth receptacle. It is suspended from a hanger so that it does not take up floor space. Also the hanger is easily stored. A disadvantage is that the horizontal slot may need to be heavily reinforced to resist tearing. Also the hanger must be removed in order to draw the bag closed. And the hanger is not very easily removed; it must be manipulated within the bag, worked out of a hole at the top and back through the horizontal slot. Also there is no carrying handle for the closed bag.

U.S. Pat. No. 2,815,785 shows a laundry bag which is suspended from a rigid hanger. This design features a side opening for depositing laundry. Such a bag can be suspended while simultaneously performing as an open mouth receptacle. The hanger is held in place by pockets near the mouth of the bag and secured by the drawstring. The side opening is sealed by snap fasteners. A disadvantage to such a bag is that as the bag is filled, items may tend to spill out of the side opening. Also the snaps may tend to come undone against the pressure of a full bag. And the hanger must be removed in order to draw the top of the bag closed.

Bags designed to be used as open mouth receptacles other than laundry receptacle bags are also known. U.S. Pat. No. 2,654,892 shows a receptacle for use as a relief container for persons traveling in automobiles. This design comprises a ring which is held within a fold at the mouth of a disposable drawstring bag. There are two versions of such bags. In one version, the ring is made of two rigid halves joined by flexible connectors. These connectors attach within recesses in the ends of the ring halves. They allow the ring to fold in the center so that it adjusts to accommodate the body contours of different users. Such bags combine a rigid frame with a stiffly elastically deformable joint. An advantage is that the mouth of the bag holds open to perform as a receptacle and folds up to create a handle as well as to adjust to different users. A disadvantage is that the ring does not provide any means of securing the contents. And the ring must be removed to draw the bag closed and twist it shut.

Drawstring or drawcord bags are well known. They are used in plastic bags as well as fabric bags. Drawstring plastic bags are commonly used as shopping bags, trash bags and disposable laundry bags.

U.S. Pat. No. 3,653,583 shows a plastic bag having a drawcord closure in which the drawcord functions as a handle. A disadvantage of this bag is that a drawcord handle is uncomfortable to use for the same reasons a bail handle is uncomfortable, as discussed previously. Another disadvantage is that three seams are required to construct the bag. As in the fabric drawstring bags, this bag is constructed of a sheet of material; the bags must be seamed on the sides and at the mouth to contain the drawstring. Generally, a seam may create a weakness in the bag wall. Also additional seams can add to the cost of production.

U.S. Pat. No. 4,445,230 shows a bag constructed of tubular plastic material. An advantage is that side seams are not required to construct such a bag. The closure, which functions like a drawstring closure to gather the bag mouth, is created by lacing ties through slots cut in the bag near the mouth. The advantage of this feature is that an additional seam is not required. A disadvantage is that the slots weaken the plastic material.

Bags formed of tubular plastic mesh are also well known. U.S. Pat. No. 4,710,967 shows a bag which is primarily designed to have high load-bearing strength. The bag takes advantage of the tube material; a double wall is created by partially inverting the tube. By vertically slitting through the fold at the mouth of the bag, a suspension loop is created. The patent recognizes the advantages of circular woven polypropylene (PP) or polyethylene (PE) material, stating that sacks made of such fabrics are chemical resistant, insusceptible to water, hygienic, non-decomposable, and have good breathing properties. Tubular plastic mesh is also strong and inexpensive. These features make it a common material for packaging.

An example of mesh of this type can be seen in U.S. Pat. No. 4,174,416. That patent shows mesh which stretches only transversely. An advantage is that bags constructed of such a mesh would not elongate when loaded. Other tubular mesh materials stretch longitudinally as well as transversely.

FR patent number 1,115,149 contains drawings that show a bag which appears to be created of a sheet of woven material. Such a bag appears to contain a sheet of graphics or a label which is laced through strands in the woven material. An advantage is that the graphics, which are used to market the bag or its contents, may be added to the outside of the bag without glue, seams, or bonding agents of any kind. A disadvantage is that either the sheet may be included as the material is being woven, or woven through the strands after the material is produced. If the label is included as the bag material is woven, it may be difficult to weave the material without catching and possibly damaging the sides of the label. If the label is added after the bag material is created, it may be difficult or time consuming to lace the thin flat label through the mesh.

U.S. Pat. No. 4,795,268 shows an extruded plastics net bag having (1) a drawstring closure; and (2) a strip of transparent material such as mesh or clear plastic sheet which is added to contain a sheet of graphics for marketing the contents of such a bag. The drawstring closure of such a bag takes advantage of the apertures of the net material; the drawstring is threaded through the apertures near the mouth of the bag. The drawstring closure surrounds the mouth of a bail handled bag. An advantage to this type of closure is what the drawstring is held near the mouth without having to be encased in a hem or run through holes cut in the bag material. A disadvantage is that the handles provided are gathered with the mouth of the bag. And slipping a hand into the gathered loops may be more difficult than into the open bail handles. Thus closing the bag with the drawstring renders the handles less useful.

A pocket is formed on the outside of the above described bag to contain a graphic sheet or label. An advantage is that such a bag can be mass produced and different sheets can be slipped into the pocket. Thus such a bag can be inexpensively produced. An small quantities can be labeled after production as desired. A disadvantage is that the corners of the label may become caught in the apertures of the mesh bag. And inserting the labels may be time consuming. It may be preferable for the label to be die-cut to have well-rounded corners. However, die-cutting adds to the expense of the bag. And since the bag is primarily designed to function as an inexpensive package, die-cutting the label may not be economical.

U.S. Pat. No. 4,932,790 shows a closure device for an extruded plastics net bag. The closure consists of a drawstring woven through apertures near the mouth of a mesh bag. The ends of the drawstring pass through a drawstring retainer which slides to close the bag. The advantage of such a closure device is that a retainer is provided to capture the ends of the drawstring and facilitate the closing of the bag mouth. Also the retainer may slide up the drawstring to close the bag. A disadvantage is that the drawstring retainer provided is constructed of a short tape fastener member, such as a wire-core "twist-tie;" such a retainer may come undone with use. Also such a retainer has ends that may catch in the apertures of the mesh used to construct a bag having such a closure device.

U.S. Pat. No. 2,598,334 shows a bag closure featuring a drawstring and a unique drawstring retainer. The retainer is designed to hold the drawstring in a drawn position by a friction fit. The retainer consists of two parallel tunnels formed of a single strip of sheet metal. The diameter of each tunnel is slightly less than the diameter of the cord. And the cord is squeezed within the tunnel so that the retainer is held in position. The sharp edges of the tunnels also help to hold the retainer in position. An advantage to this type of closure is that the retainer is held in place without having to tie the ends of the drawstring. A disadvantage is that the sharp edge of the retainer may cause damage to the cord after repeated use.

Bags having a double wall are well known. U.S. Pat. No. 2,043,782 shows a method of making double bags constructed of a single piece of material. The place of material is folded in half, and the three open sides are seamed closed. One half of the closed piece is then folded or telescoped into the other half to form the double wall. An advantage of such a bag is that only three seams are required to create a double wall. Such a bag may also be formed of a tubular woven mesh so that no side seams are required to construct the bag. An advantage of such a bag is that it may be more economical to produce than other double-wall bags. Also there is no opening between its inner and outer walls. And items will not get trapped between the two walls, provided that the items dropped into the bag are larger than the spaces between the strands of the woven material. Further, such a bag has extra strength because of its double wall and double seamed bottom. A disadvantage of such a bag is that no closure is provided for the mouth of the bag.

U.S. Pat. No. 3,826,296 shows a double-wall or self-lining handbag. Such a bag shares the advantages of the above mentioned double-wall bag. However, it has the additional advantage of a mouth closure. The mouth closure of the bag is constructed of closure strips or self-closing tapes such as hook-and-loop fastener. An advantage is that this type of closure is concealed when the bag is closed. Also it may be less expensive to manufacture than other closure devices. A disadvantage is that closure tape of this kind may tend to collect foreign particles, and become inoperative over time. The semirigid hooked or barbed bristles of one tape may become clogged with soft fragments of material such as paper tissue, hair, or lint. If clogged, it may no longer be capable of sufficiently connecting to the other tape to secure the contents of the bag.

U.S. Pat. No. 735,560 shows a double-wall bag having a drawstring closure. Advantages of both a double-wall bag and a drawstring closure are discussed previously. A disadvantage to such a bag is that a series of longitudinal guide-loops are added onto the outside of the bag to capture two drawstrings. And it may be time consuming, and therefore uneconomical to add a series of loops.

At present, many recyclable materials are added to landfills which are already overcrowded. This is partly due to the fact that collection of these materials relies primarily on the voluntary efforts of the consumer, and it is inconvenient to sort the materials and transport them to the recycling centers. A solution is to provide the consumer with a product that will aid in the collection process. A few products have recently emerged. For example, there are stacking bins which are labeled "glass," "newspaper" and "cans." A disadvantage of these bins is that they are space consuming. Also they are difficult to carry; generally only one or two can be carried at a time.

Another available product is the "Bagit System" by Mid-Atlantic Waste Systems. The "Bagit System" consists of a large bag with a drawstring closure and a rigid frame which supports and holds two of the bags open. The bags are capable of holding larger quantities than the bins. However they too are space consuming when attached to the frame. They are difficult to carry when full, and share other disadvantages of the drawstring bags previously cited. An additional disadvantage of the "Bagit" bags is that the drawstring may not function as effectively as in other bags. The materials used for the bag and the drawstring may not slide as smoothly against each other as in other bags, and the drawstring ends can bend sharply as they pass through a grommet at the front of the bag, causing them to bind when pulled.

At recycling centers glass is presently separated into "clear," "brown," and "green." In addition to newspaper, glass and aluminum cans, other materials are currently being recycled. Plastic foam is chipped and used for insulation. Some plastic containers are ground and formed into fibers for carpet. And non-aluminum cans are used for scrap metal. It is likely that more materials will be added as industry discovers new uses for the "recyclables." Therefore to recycle most effectively, the consumer who sorts their recyclables, may need to be able to sort eight or more materials. The containers used for these materials must be as compact as possible, yet capable of holding a sufficient quantity to justify a trip to the recycling center. They must perform as open-mouth receptacles so that it is convenient to deposit materials. They should be easy to close and carry. And they should preferably be constructed of a material that is strong and easily maintained. It is important to note that most recyclable containers should be thoroughly rinsed prior to their collection. Therefore a mesh material which allows the materials to dry is optimal. If this were not the case, a solid material that would contain any foodstuffs would be preferable.

SUMMARY OF THE INVENTION

The present invention is for a bag mouth closure structure having a semirigid drawstring, which may attach to a variety of bags to serve numerous functions. The semirigid drawstring assists in holding the mouth of a bag open. Its rigid components allow a bag to be suspended and simultaneously perform as an open mouth receptacle. An advantage of a hanging receptacle is that it frees valuable floor space and maximizes the utility of wall space. Also there are many uses for a suspended open mouth receptacle. Uses include the deposit of articles such as recyclables or laundry and the deposit and storage of items such as toys, athletic gear, cosmetics or tools.

Semirigid is defined as moderately rigid. Preferably, the flexible string portion of the drawstring is itself a semirigid material such as plastic tubing. A moderately rigid cord would hold the mouth of a bag more fully open than a very supple cord. Semirigid is also defined as having rigid components. The handle portion of a drawstring structure of the present invention gives it the rigidity which characterizes it as a semirigid drawstring.

The combination of a substantially rigid handle portion and a flexible portion allows a bag to be suspended by the rigid portion of the drawstring. And the drawstring can be operated while the bag is suspended. This combination also allows a bag to remain open while hanging so that it performs as an open mouth receptacle.

There are several specific ways to construct a semirigid drawstring closure structure of the present invention. It can be created by attaching flexible cord to the ends of a substantially rigid handle. It can also be created by lacing a flexible cord through a hollow handle. Lacing the cord through the handle is less complicated and may be stronger than attaching two pieces of cord to the ends of the handle.

A semirigid drawstring of the present invention can be formed of a plastic tubing handle with string, a plastic tubing handle with flexible plastic tubing, a p.v.c. (or polyvinyl-chloride) tubing handle with smaller diameter tubing, a p.v.c. tubing handle with string, a wood handle with string, a wood handle with leather, a bamboo handle with string, a bamboo handle with leather, a metal tube handle with wire and even a tempered glass tube handle with ribbon or string.

A semirigid drawstring of the present invention can also include more than one handle. The flexible portion can be laced through two handles. Or a tube handle could substitute for the retainer which serves to capture the ends of the drawstring. The ends of the flexible portion of the drawstring can pass through a second handle, crossing within, and the ends can be pulled to draw the two handles together. Thus a semirigid drawstring of the present invention can be formed of two tube handles of plastic, wood, metal, rubber, p.v.c., bamboo or glass; with wire, string or cord of plastic, nylon, metal chain, cotton, fiber, leather, rubber or vinyl.

A bag employing a bag mouth structure of the present invention can be drawn closed while hanging. And if the flexible portion of the drawstring is constructed of plastic tubing as preferred, the ends of the drawstring do not necessarily have to be tied together to secure the contents of the bag. Rather, the bag may be held closed by a friction fit within the drawstring retainer. Plastic tubing stretches so that the diameter of the cord is reduced when it is pulled. Thus the cord may slide easily through a retainer for closing the bag. When the ends of the drawstring are released, the cord returns to its original diameter and binds within the retainer. Preferably, the ends of the drawstring enter the drawstring retainer from opposite sides and cross over each other within the retainer. This also helps to hold the mouth of a bag drawn closed. The material, especially if it is plastic tubing will bind to itself when two pieces are held closely together. And the drawstring ends will resist the tendency to slide against each other.

In the present invention, the mostly rigid portion of the semirigid drawstring functions as the handle for an attached bag. The handle is useful for suspending a bag. It can hang on a hook or hooks. A broad open hook positioned at the center of the handle or, preferably, two open hooks positioned on either side of the handle's center prevents the bag attached from pivoting and sliding to one side. The mostly rigid handle effectively spreads the pressure applied to the hand by the weight of the contents of an attached bag. Thus it provides a comfortable handgrip for a bag.

Through a hollow handle, alongside the drawstring, a loop of material which forms a shoulder strap may be added if desired. A shoulder strap is useful for conveniently carrying the bag or for hanging the bag from a doorknob or hook. An advantage of a shoulder strap is that the user can keep his hands free while carrying the bag.

A shoulder strap is useful for attaching a bag to a shopping cart. A potential problem of taking reusable bags to the store, is that generally one needs to take several. And several bags may consume valuable shopping-cart space. In the present invention, a long shoulder strap may be provided. This shoulder strap may be looped over the handle of the cart, and the bag body slipped through the loop to suspend the bag from the shopping-cart handle. Or an "s-shaped" hook can slip over the cart handle and serve to capture the shoulder strap of a bag. Thus one bag can be hung from the shopping-cart handle. And the remainder of the bags can be carried in the hanging bag, so that the inside of the cart is not cluttered with shopping bags.

Also the addition of a shoulder strap makes a bag having a bag mouth structure of the present invention useful to people in wheelchairs. The shoulder strap can be looped over the handle bars in back of the wheelchair. The open mouth of the bag facilitates the easy deposit of items into the bag. The person can either reach around the side of the chair to deposit an item, or they can drop the item over their shoulder into the bag. If the bag is positioned so that the bag mouth is roughly parallel to the arms of the wheelchair, a person can reach around the sides of the chair with both hands, feel for the ends of the drawstring, and draw the bag closed by pulling the drawstring ends horizontally. They can also use the shoulder strap to retrieve the bag. They can grab onto the portion of the shoulder strap that runs between the handles, unhook the bag from the handles and pull the bag around to the front of the chair.

An additional surprising function of a shoulder strap is that it can be used to wrap the bag into a neat and attractive package. The bag can be rolled parallel to the handle, and the shoulder strap can be wrapped around the rolled-up bag. The top of the loop of the shoulder strap can be hooked over the drawstring retainer, and the ends of the drawstring can lay over the shoulder strap to hold it in place. Because it is intended that the present invention be used in a reusable shopping bag to help cut down on the waste caused by disposable bags, and because it is intended for use in a bag that serves as a receptacle for recyclables, it may be considered contradictory to wrap the bag in disposable packaging. Unless the disposable packaging is perceived to perform a vital function, any attempt to market the product with superfluous packaging may likely have a negative effect on sales. Therefore the shoulder strap serving the dual function of containing the bag in a neat bundle, may prove to be an effective marketing tool.

As mentioned previously, either the shoulder strap or the handle is useful for suspending a bag having a bag mouth structure of the present invention. This is an especially useful feature for a shopping bag or a tote bag, because it facilitates the unloading of the bag's contents. A full bag can hang, and the drawstring closure can remain open so that the bag's contents can be conveniently unloaded.

It is an object of the present invention to include any structure having a semirigid drawstring as defined which attaches to a bag. And it is believed that an extensive line of bags may be based upon a bag mouth structure of the present invention. Following are examples of some preferable ways the structure may attach to a bag and some preferable bag configurations.

The top edge of a bag may be hemmed. And the hem may encase the flexible string and handle. Or a tube of material may be partially inverted to create a double wall, and the drawstring and handle may be held within the fold at the top of the bag. A hole in the material at or near the top of the bag may be provided to allow the drawstring ends to pass through and engage a drawstring retainer. Because a double-wall bag may not have a hem to capture the semirigid drawstring, the engagement of the drawstring ends and the retainer would assist in holding the drawstring in place. Ties, such as string ties, may be added to hold the handle portion of the drawstring within the fold. These ties would pass through holes inthe bag material located just below the handle. They would tie around the handle to hold the bag material tightly in place. Ties may also be used to position a handle printed with graphics. If the bag material is transparent or is cut away to expose a portion of the handle, ties would assist in preventing printing on the handle from turning to a position where it is upside-down or not visible. These ties could be made of any material. Preferably they are made of a stretchy plastic material such as plastic tubing. Plastic tubing when tied together in a half knot effectively binds and stays tight. Other materials may need to be tied in a full knot. And a half knot may be neater in appearance than a full knot.

If desired a shoulder strap may be attached to the bag. Holes may be cut in the bag material at either end of the handle to allow the shoulder strap to engage the handle. If the bag is of a stretchy material or if the handle can move within the fold or hem at the top of the bag, it is preferable to add ties around the handle when attaching a shoulder strap. The ties may assist in holding the holes for the shoulder strap in position over the ends of the handle.

The bag mouth structure may be attached to a bag formed of a tubular mesh. The tubular mesh can be made to specification. Variables include material, color, tube diameter; mesh size, shape and weight.

There are advantages to using a tubular mesh for a bag emplioying a bag mouth structure of the present invention. It is expandable to accommodate large holding capacities. Also no side seams are necessary to create the bag. And the mesh openings can facilitate the assembly of the bag. The drawstring ends can pass through the mesh openings from inside a hem at the mouth of the bag to engage the retainer located outside the hem. And the shoulder strap can pass through mesh openings to engage and attach to the handle.

An advantage of mesh is that it is transparent. And the contents of a mesh bag are mostly visible. For a tote bag a transparent material facilitates the retrieval of items in the bag as they are needed. For a reusable shopping bag a transparent material minimizes the suspicion of shoplifting. In fact, a transparent bag using a mouth structure of the present invention, is a convenient substitute to shopping baskets or carts when shopping for only a few items. It may be conveniently carried by either the handle or the shoulder strap; the mouth of the bag may remain open so that merchandise can be easily deposited; and the items are visible, so that the suspicion of shoplifting is minimized.

An advantage of plastic mesh is that it is nonabsorbant and easily cleaned. Nonabsorbancy is an essential feature for a reusable receptacle for recyclables. Even though recyclable containers are generally rinsed free of any contaminates, some residual contamination may be left. Therefore it is necessary for a reusable container for recyclables to be easily cleaned. Mesh provides the structure necessary to contain the recyclables without the surface area of solid plastic. It is more easily cleaned because the rinse water is not retained in the bag. And the bag and its contents are allowed to air dry. Also mesh expands to accommodate the number of recyclables deposited into the bag. And the transparency of the mesh facilitates the sorting of materials. The contents of the bag are visible so that it is not necessary to label the bag with the type of material that it contains.

An advantage of tubular mesh is that it can be inverted upon itself to form a double-wall bag. The inversion, or fold at the mouth of the bag can contain the drawstring and handle. An advantage of a mesh bag having a double wall is that an item such as a disk printed with promotional advertising can be trapped between the inner wall and the outer wall of the bag. This item or disk is visible because of the transparency of the mesh. A promotional disk becomes a marketing tool for the bag. Stores may be more willing to provide a reusable shopping bag at a minimal cost to customers if the bag serves as a promotional item. Also communities may be more willing to provide citizens with bags for use as receptacles for recyclables if promotional advertising can be printed on the bag. Also companies may be willing to purchase the bags if they can carry promotional advertising. An advantage of a disk is that there are not sharp corners to catch in the mesh apertures. Also the disk may be free to move between the layers of the mesh. This movement may be more eye-catching than a stationary label.

An alternate way of attaching a mouth structure of the present invention involves longitudinally slotting the handle. The width of the slot is preferably less than the diameter of the flexible string. The string alone is encased in a hem or fold in the top of the bag. Or it is woven through apertures in the top of a mesh bag. The edge of the bag containing the string is captured within the handle and retained behind the slot. An advantage of slotting the tube and attaching the bag in the manner described is that a shoulder strap may be added without passing though the bag material.

The bag that attaches to a mouth structure of the present invention may be constructed of any material deemed useful. A material with some stiffness may be preferably. The semirigid drawstring assists in holding the mouth of a bag open.

However this feature is optimized when used with a bag material stiff enough to withstand buckling under the weight of the flexibe string and drawstring retainer. A supply bag having a semirigid drawstring closure may remain fully open when partially filled. Nevertheless, it may be preferable to reinforce a bag made of supple material with a rib running the length of the bag in the front center, opposite to the side containing the handle. This rib may be printed with a logo, graphics or advertisement so that it serves a dual purpose.

An easily stained machine washable material, such as cotton canvas, may be used to construct a bag attached to a mouth structure of the present invention. It is preferable that such a bag detaches from the mouth structure for cleaning. Snaps at the hem or a removable flange at the end of the drawstring may be included to free the mouth structure from the soiled bag. Although detaching and reattaching the bag may be inconvenient, it would only be for periodic cleaning. It is important to note that removing the bag is not necessary for effecting any of the functions of the mouth structure.

Used as the mouth structure in a storage bag for toys, the present invention is safer for children than an ordinary drawstring closure. The drawstring's rigid components prevent it from tightly encircling any part of a child's body. And there is less risk of suffocation or of cutting of blood circulattion. Also, the ends of the drawstring are knotted or flanged, so that the drawstring retainer can not easily be removed by a child. Thus the risk of choking on the retainer is less than in toys having removable small parts. It is important to note that a bag mouth structure having a removable flange at the end of the drawstring should not be used as a toy storage bag for children, unless the flange is designed so that a young child can not remove it.

A mouth structure of the present invention can be used to create a bag or pouch that may be strapped to a person's waist, or attached to a belt. A belt material could be substituted for the shoulder strap so that the bag can strap onto a persn's waist. Or the handle portion of the mouth structure can fasten to a belt via slots, loops or some other means. The handle could be contoured or curved to comfortably fit against the body. The semirigid drawstring holds the bag open so that its contents are easily obtained. And it can be drawn closed so that the contents are secured. A pouch having a mouth structure of the present invention would be especially useful to a person who uses several small tools while working. The person could keep the tools readily accessible yet safely contained as they work.

Also a bag mouth structure of the present invention can be used to create a flexible container for drafting tools that can hang at an edge of a drafting table. A common problem with drafting is that generally several tools are required in the drafting process. If a person drafting prefers to tilt the surface of the table, keeping the tools on the table becomes a problem. A shallow bag, as wide as desired, may be produced using a mouth structure of the present invention to safely store these tools along the bottom edge of the table, or any side, off of the table's surface. The bag can hang by its handle via hooks or loops fastened to the edge of the table, or it can be suspended from a strap attached to the bag. A flexible container may be more practical than a rigid container because it is not as great an interference to the person's legs under the table. Also gravity will cause a flexible bag to naturally hang perpendicular to the floor, so that items contained in the bag do not fall out when the angle of the drafting table is changed. And the mouth of the bag can be drawn closed to secure the drafting tools after use.

Two mouth structures can be used to create a double-mouth bag. A mouth structure may be attached to each end of a tube of material. The tube of material can be folded in half so that both mouth structures are at the top of the bag. The fold may be seamed closed. Or it can remain open so that the contents of both bag halves can be dumped, by simply opening and dropping one end of the double-mouth bag.

Also a divided bag haivng a mouth structure of the present invention may be created. A longitudinal seam positioned directly under the drawstring retainer can connect the front bag wall to the back bag wall to create two separate sections in a bag. Each section can be opened and closed independently by pulling only one end of the drawstring.

A mouth structure of the present invention may be attached to exising bags. For example, the structure may attach to a disposable plastic bag via clips or pins so that the bag becomes useful as an open mouth receptacle for items to be disposed of. The top of a bag could be inserted through the mouth structure, folded over the handle and flexible string portions of the semirigid drawstring and temporarily fastened to the structure. It can be filled with disposables that need to remain in a bag. And the bag can be removed from the structure for disposal. From an environmental standpoint it would be more advantageous to reuse a disposable bag at least once, than to simply through it away. It is feasible, therefore, that a structure of the present invention may be sold as a separate product for use with existing bags.

It is an object of the present invention to provide a bag mouth structure which combines advantages of the mouth structures of specific bags.

It is a further object of the present invention to provide a bag mouth structure which can attach to various bags of differing materials and configurations so that an extensive line of bags may be produced.

It is a further object of the present invention to provide a mouth structure which creates multiple uses for the attached bag thereby minimizing waste caused by disposable bags.

It is a further object of the present invention to provide the consumer with a product useful for sorting and transporting recyclable materials so that the collection of these materials is more successful.

It is a further object of the present invention to provide a bag mouth structure which enables a bag to hang from a hook or doorknob and simultaneously perform as an open mouth receptacle without the aid of a separate rigid support.

It is a further object of the present invention to provide a bag mouth structure which enables a bag to be easily carried.

It is a further object of the present invention to provide a closure to a bag which secures the bags contents.

It is a further object of the present invention to provide a mouth structure for a bag to which a shoulder strap can be attached thereby increasing the bags usefulness.

BRIEF DESCRIPTION OF THE DRAWINGS

The invention is now illustrated in detail by means of the drawings in which.

DESCRIPTION OF THE PREFERRED EMBODIMENT

Figure 1:
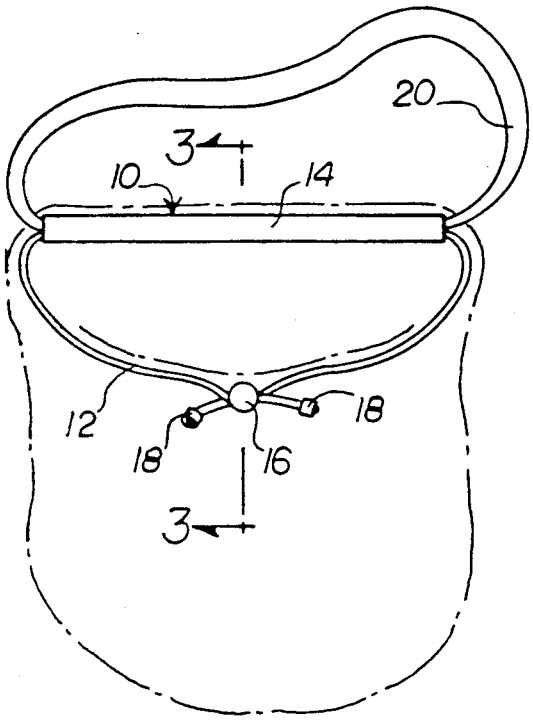
FIG. 1 is a front elevational view of a preferred embodiment of a bag mouth structure according to the present invention.

Referring to the figures, FIG. 1 shows a bag mouth structure having a semirigid drawstring generally, 10 comprising a flexible string 12 and a handle 14. The flexible string 12 attaches to the handle 14. The ends of the flexible string 12 pass through a drawstring retainer 16 from either side, crossing within. The ends of the flexible string 12 are then knotted 18 to hold the drawstring retainer 16 in place. A shoulder strap 20 is shown attached to the handle 14 of the bag mouth structure.

Figure 2:
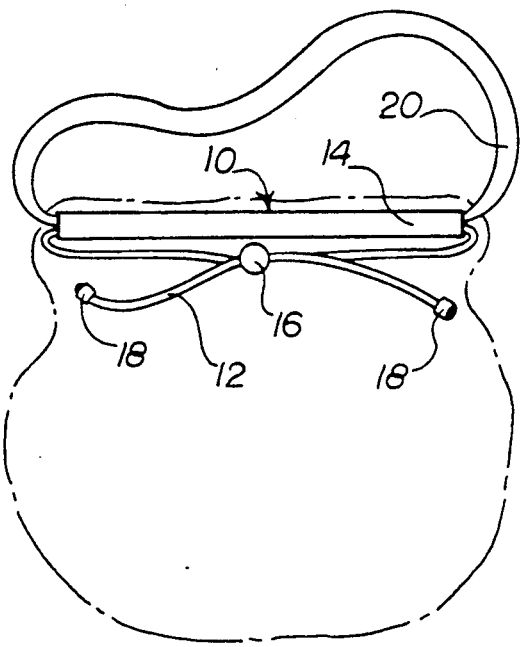
FIG. 2 is a front view of the bag mouth structure of FIG. 1 showing the bag mouth structure drawn closed.

FIG. 2 shows the bag mouth structure in a closed position. The ends of the flexible string 12 have been pulled through the drawstring retainer 16 to draw the semirigid drawstring 10 closed.

Figure 3:
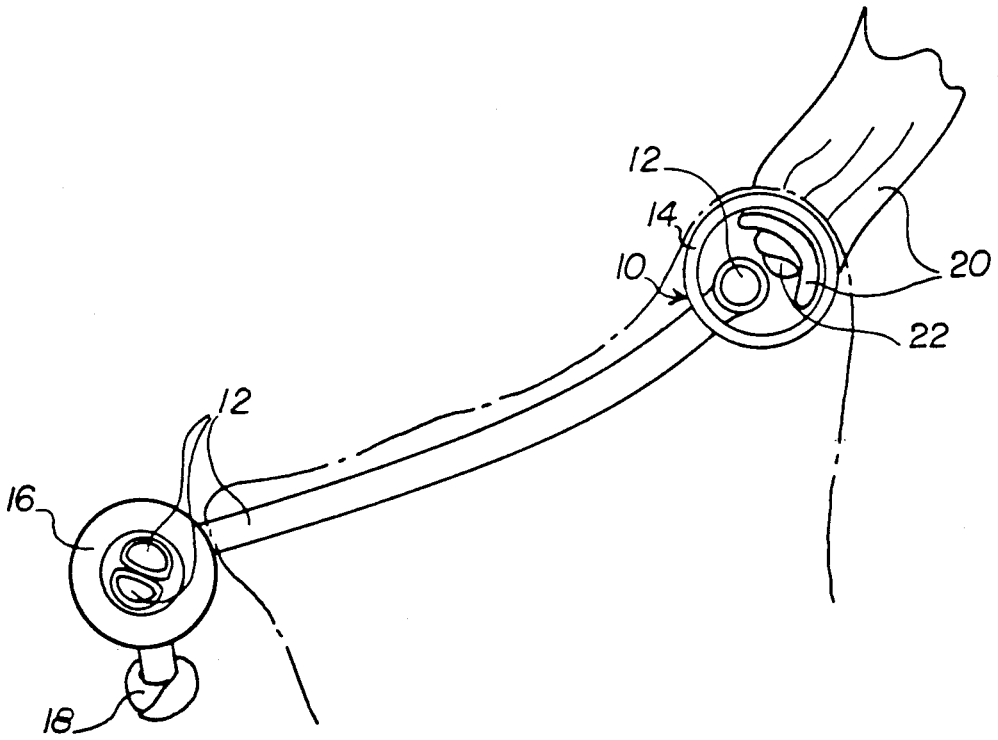
FIG. 3 is an enlarged sectional view of the bag mouth structure of FIG. 1 taken along lines 3—3 of FIG. 1.

FIG. 3 shows an enlarged sectional view of the bag mouth structure. The flexible string 12 and the shoulder strap 20 are shown laced parallel through the handle 14. The ends of the shoulder strap 20 are joined by a knot 22 to form a closed loop. The knot 22 is contained within the handle 14. FIG. 3 also shows the end sections of the flexible string 12 within the drawstring retainer 16. The cross sections of the two ends of the flexible string 12 are shown to be compressed, because their combined diameters are slightly greater than the inside diameter of the drawstring retainer 16. Thus the flexible string 12 sections are pressed together to bind within the retainer 16.

Figure 4:
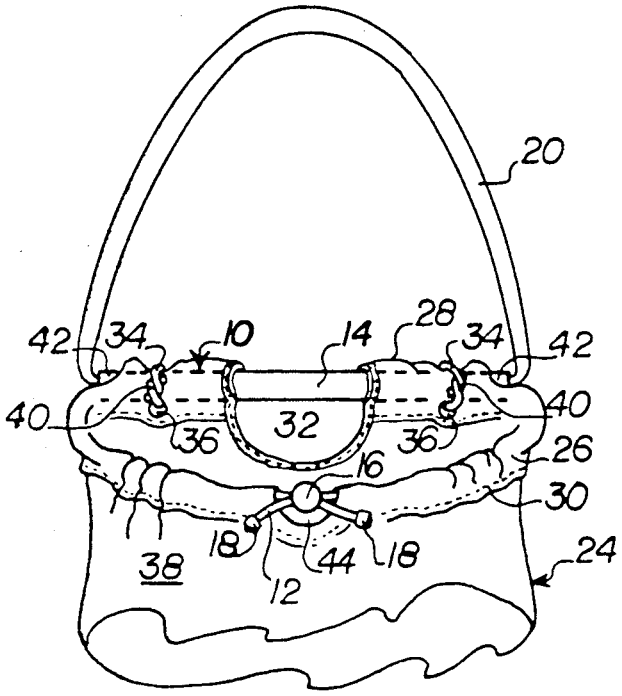
FIG. 4 is a front elevational view of the bag mouth structure of FIG. 1 shown attached to the top portion of a bag.

FIG. 4 shows a top portion of a bag 24 attached to the mouth structure. The bag 24 contains a hem 26 at the top 28 which is created by a line of stitching 30. Within the hem 26, the semirigid drawstring 10 is contained. A hole 32 is cut into the top 28 of the bag 24 to expose a portion of the handle 14. To assist in securing the bag material 38 and the handle 14 in place, ties 34 are added. The ties 34 pass through holes 36 in the bag material 38 and are fastened onto the handle via half-knots 40. Holes 42 are added over the ends of the handle 14 so that the shoulder strap 20 can attach to the handle 14. Also a hole 44 is added so that the ends of the drawstring 10 can exit the hem 26 to engage the drawstring retainer 16.

Figure 5:
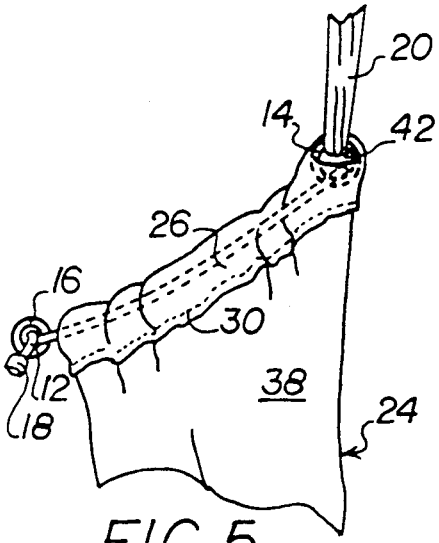
FIG. 5 is an enlarged side elevational view of the bag mouth structure of FIG. 1 shown attached to the top portion of the bag in FIG. 4.

FIG. 5 shows a side view of the bag 24. The side hole 42 cut to allow the shoulder strap 20 to attach, exposes only a portion of the end of the handle 14. In that way, the bag material 38 helps to retain the handle 14 in position.

Figure 6:
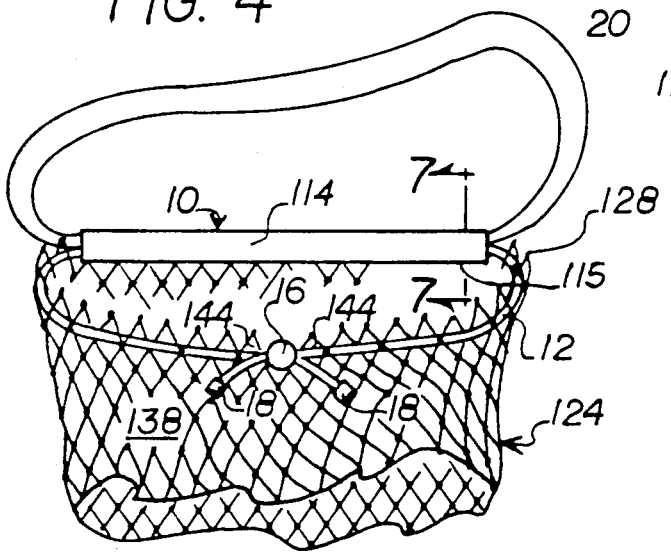
FIG. 6 is a front elevational view of the bag mouth structure of FIG. 1, further comprising a slot in the bottom of the handle portion of the drawstring, shown attached to the top portion of a bag.

FIG. 6 shows a bag 124 constructed of a tubular mesh material 138. The top 128 of the bag 124 is attached to the bag mouth structure via the engagement of the flexible string 12 and the handle 114. Handle 114 is similar to the handle 14 of the mouth structure in FIG. 1. The difference is that the handle 114 contains a slot 115 along its bottom edge. The flexible string 12 is woven through apertures around the top 128 of the bag. And a portion of the top 128 of the bag passes through the slot 115 and is retained within the handle 114. Because the bag 124 attaches to the bottom of the handle 114 the shoulder strap 20 attaches without having to pass through the bag material 138. Apertures 144 in the mesh material 138 allow the ends of the drawstring 10 to engage the drawstring retainer 16, so that no additional holes need to be cut into the bag 124.

Figure 7:
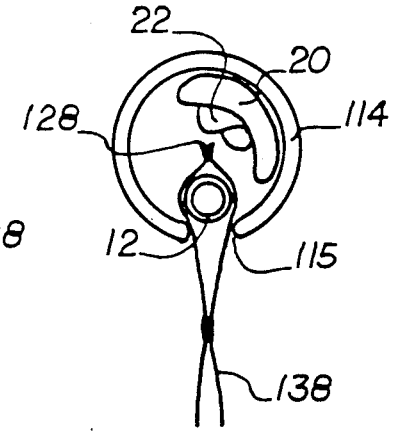
FIG. 7 is an enlarged sectional view of the bag mouth structure of FIG. 1 as depicted in FIG. 6, taken along lines 7—7 of FIG. 6.

FIG. 7 shows an enlarged sectional view of the portion of the top 128 of the bag 124 captured within the handle 114 via a slot 115. The slot 115 is slightly narrower than the diameter of the flexible string 12. Thus the string 12, which is attached to the top 128 of the bag 124, is retained within the handle 114. And the bag material 138 is allowed to pass through the slot 115.

Figure 8:
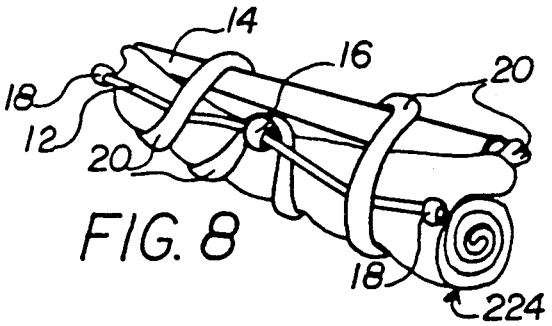
FIG. 8 is a perspective view of the bag mouth structure of FIG. 1 showing how a shoulder strap may be used to wrap an attached bag.

FIG. 8 shows a rolled bag 224 neatly "packaged" by its shoulder strap 20. The ends of the flexible string 12 are woven over and under the portions of the shoulder strap 20 that are in the front of the bag 224 to help hold the shoulder strap 20 hooked over the drawstring retainer 16.

In the preferred embodiment of the present invention, the semirigid drawstring 10 comprises a flexible string 10 and a handle 14. However it could be made of a single material. In other words, it could be molded of plastic, and designed to have flexing members. These members should flex enough to suitably draw the mouth of a bag closed.

The flexible portion 12 of the semirigid drawstring 10 is vinyl tubing. Vinyl tubing is flexible yet semirigid so that it helps hold the mouth of a bag more fully open. However, the flexible portion 12 of the drawstring 10 could be supple string or cord of cotton, plastic, leather or any plant fiber. And it could be a hard material such as plastic, wood or metal that is segmented or pleated so that it flexes. It also could be metal wire or even chain.

The handle portion 14 of the semirigid drawstring 10 is a hollow tube. However it could be created as simply a more rigid portion of the flexible part 12 of the semirigid drawstring 10. The handle 14 could be a wide segment of a semirigid drawstring 10 that is constructed entirely of segmented rigid material.

The handle 14 is preferably a plastic tube of a mostly rigid material such as acrylic or polycarbonate. And the sharp edges at the ends of the plastic tube are preferably rounded. However it could be made of a more flexible tubular material such as a poly-vinyl-chloride pipe (PVC), polyethylene or polypropylene tube, or rubber. It could also be made of other tubular materials such as metal pipe, bamboo or even a tube of tempered glass.

Preferably the handle 14 is a hollow tube so that the flexible string 12 and the shoulder strap 20 can pass through the handle 14 to attach. However it could be a solid material such as a solid plastic or metal rod, or a wood dowel. And it could be any form deemed beneficial to the function or appearance of a mouth structure of the present invention. It could be curved or contoured in any way.

The flexible string 12 preferably passes through the handle 14. But it could be divided into two segments. And each segment can attach to an end of the handle 14. The handle 14 could have recesses in both ends for the attachment of the flexible string segments 12. And the segments can be held in the recesses via friction fit, glue, or pins that slide in from the side. Or screw eyes can be attached to the ends of the handle, and the ends of two segments of flexible string 12 can tie to the screw eyes or to hooks or links that attach to the screw eyes. The segments of flexible string 12 could be fastened to the handle 14 in any way that is deemed satisfactory.

The ends of the flexible string 12 are captured by a retainer 16 that is preferably a bead. However, it is the intention of the present invention to define a drawstring retainer 16 as any means of sufficiently closing the loop of the semirigid drawstring so that it may function to close a bag mouth. It is feasible that a hole in the material of a bag would be sufficient to retain the ends of the drawstring 10. The hole could be reinforced by a grommet so that the grommet becomes the drawstring retainer 16. It is also feasible that a slip knot or half knot created by the ends of the flexible portion 12 of the drawstring 10 could serve as the retainer 16. Or one end of the flexible portion 12 of the drawstring 10 could be fastened to a hollow handle 14 and the other end could wrap around the mouth of a bag and lace through the handle 14. And the end that is laced through the handle could be pulled to draw the bag mouth closed. Thus the handle 14 could serve as a retainer 16. The drawstring retainer 16 could also be a length of plastic, metal, wood or rubber tube. The tube could be very small or large enough to function as a second handle. If the retainer 16 functions as a second handle, the ends of the drawstring can be pulled horizontally to draw the two handles together for closing the bag mouth. Also, a second shoulder strap may be added to the second handle, in the same way that the shoulder strap 20 is added to the primary handle 14.

The ends of the flexible portion 12 of the drawstring 10 enter the drawstring retainer 16 from either side and cross within. However, they could both enter the retainer 12 from the same side, so that the retainer 16 slides up the end segments of the string 12 to close the mouth of a bag.

The ends of the drawstring 10 are knotted 18 to hold the retainer in place. However, they could be flanged in any way. A piece of material could be added to the outside of the end of the string 12, or inserted into the end, if the end of the string 12 is recessed. Also the drawstring 10 could be one continuous loop. An end of the drawstring 10 could pass through the retainer 16, and through a ring or bead that is preferably larger than the inside diameter of the drawstring retainer. 16. Then the end of the drawstring 10 could be laced back through the retainer 16 from the opposite direction. In this way, the "ends" of the drawstring 10 are actually a closed loop containing a bead or flanged portion to hold the retainer in place.

The drawstring 10 is shown to have one flexible string 12 and one drawstring retainer 16. However a mouth structure for a double bag or "Siamese-twin" bags can be formed by simply adding another flexible string 12 and drawstring retainer 16 to the handle 14. This would work especially well if a handle 114 containing a slot 115 is used. Both flexible strings 12 could be threaded through the bag material 136 at the top 128 of both bags 124 and retained behind the same slot 115. Or two slots 115 can be cut into the handle 114 to retain the two flexible strings 12 so that the twin bags are held slightly apart.

A shoulder strap 20 is shown as a desirable addition to the bag mouth structure. However it is not necessary that a bag attached to a mouth structure having the semirigid drawstring 10 have a shoulder strap 20 to function as a suspended open mouth receptale. The shoulder strap 20 is made of a material that can lay flat to spread the pressure applied to the shoulder by the weight of the bag over a larger area. It is also supple and can gather to tie into a knot 22 that is small enough to fit inside of the handle 14. However it could be made of any material considered useful to perform as a strap that suspends a bag. It could be a rope, string or cord, of cotton, plant fiber, leather or plastic. It could even be an arc of wood or plastic, or a metal strip, wire or chain.

The shoulder strap 20 is laced through the handle 14. But it could be fastened to the handle 14 in any useful way. It could attach to the ends of a solid handle 14 the same ways the flexible portion 12 of the drawstring 10 can attach to the handle 14 as mentioned previously. Or it could be fastened to rings or ties 34 that encircle the handle 14. Or the ends of the shoulder strap 20 could tie around the handle 14 to function as ties 34 that help to secure the bag material 38 to the handle 14.

A bag 24 is shown to contain a semirigid drawstring 10 within a hem 26 at its top 28. However, the semirigid drawstring 10 could be attached to the bag 24 below its top 28 to create a flap of material 38 around the mouth of the bag 24 if desired. The bag 24 is shown as a single wall bag. However it could be a double wall bag. And the semirigid drawstring 10 could be contained within a fold at the bag's top 28. A fold is created when a tube of solid material 38 or a tubular mesh material 138 is partially inverted to create a double wall.

Holes 42 in the bag material 38 are provided at the ends of the handle 14 so that the shoulder strap 20 may engage and attach to the handle 14. However, apertures in a mesh material 138 could serve this function. Also Holes 42 are not necessary if a shoulder strap 20 is not added.

Ties 34 are added to secure the bag material 38 to the handle 14 and to hold the handle 14 in position. These ties 34 are made of the same material that the flexible string 12 is made of. However they could be any material that can be tightened around the handle 14. They could be a supple material such as leather, cotton, plant fiber or soft plastic. Or they could be strips or rings of rigid metal, plastic or wood. Also, instead of ties, anything that secures the materials together could be used such as glue or even a pin or brad that pierces the material 38 and the handle 14.

A hem 26 is sealed by stitching 30 the folded part of the top 28 of a bag 24 to the bag material 38. However, the bond could be made with hook-and-loop fastener, snaps, glue, a heat weld, a zipper or any useful means. Or, instead of a hem 26, a bag 24 having loops or rings attached to its top 28 edge could be fastened to the mouth structure. The loops or rings could encircle or attach to the semirigid drawstring 10 at critical points and substitute for the hem 26.

A bag 124 is shown to have a handle 114 containing a slot 115 used for attaching the bag 124 to the mouth structure. The flexible string 12 is woven through apertures at the top 128 of the mesh 138 bag 124 and captured within the handle 114 behind the slot 115. However, a solid material 38 could be used to construct the bag 124. And the flexible string 12 could be encased in a hem.

A slot 115 is made through the wall of the hollow handle 114. However, the slot 115 could be a groove in a solid handle 114. It could be contoured to retain both the flexible string 12 and the top of the bag material 138 which encircles the string 12.

I claim:

1. A semirigid drawstring closure structure which is adapted to be attached to and surround the mouth of a bag to assist in keeping the bag mouth open when desired, comprising:

(a) a substantially rigid handle having two ends, said handle being adapted to be secured directly to a bag mouth;

(b) a flexible string having two ends, said string being attached to said handle; and (c) a retainer for capturing the drawstring to hold the mouth of a bag closed when the semirigid drawstring closure structure is attached to a bag, said retainer engaging adjacent to the ends of the string.

2. A device according to claim 1 in which the handle is formed of substantially rigid plastic tubing.

3. A device according to claim 1 in which the flexible string is formed of flexible plastic tubing.

4. A device according to claim 1 in which the retainer is a bead.

5. A device according to claim 1 further including a shoulder strap formed of an additional loop of material attached at the ends of the handle, said loop of material being seperate and unconnected to the flexible portion of the semirigid drawstring.

6. A semirigid drawstring closure structure which is adapted to be attached to and surround the mouth of a bag to assist in keeping the bag mouth open when desired, comprising:

(a) a substantially rigid handle having a generally c-shaped cross section and two ends, said handle being adapted to be secured directly to a bag mouth;

(b) a flexible string having two ends which is laced through said handle;

(c) a retainer for capturing the drawstring to hold the mouth of a bag closed when the semirigid drawstring closure structure is attached to a bag, said retainer engaging adjacent to the ends of the string.

7. A device according to claim 6 in which the handle is formed of substantially rigid plastic tubing.

8. A device according to claim 6 in which the flexible string is formed of flexible plastic tubing.

9. A device according to claim 6 in which the retainer is a bead.

10. A device according to claim 6 further including a shoulder strap formed of an additional loop of material laced through the handle, said loop of material being seperate and unconnected to the flexible portion of the semirigid drawstring.

11. A semirigid drawstring closure structure which is adapted to being attached to and surround the mouth of a bag to assist in keeping the bag mouth open when desired, comprising a substantially rigid hollow handle having two ends, wherein said handle is adapted to be secured directly to a bag mouth; a flexible string having two ends, wherein said string extends through said hollow handle and can be threaded through openings in the top of a bag to attach to a bag mouth; and a retainer for capturing the drawstring to hold the mouth of a bag closed when the semirigid drawstring closure structure is attached to a bag, said retainer engaging adjacent to the ends of the string.

12. A device according to claim 11 which attached to a bag mouth wherein said bag mouth has a fold in its top portion and the ends of the flexible string are threaded through openings in the fold at the bag mouth to engage the retainer.

13. A device according to claim 11 in which the retainer is a bead.

14. A device according to claim 11 in which the flexible string is formed of flexible plastic tubing.

15. A device according to claim 11 in which the hollow handle is formed of substantially rigid plastic tubing.

16. A device according to claim 11 in which the hollow handle has a generally c-shaped cross section.

17. A device according to claim 11 in which the hollow handle has a generally c-shaped cross section and the flexible string is threaded through openings in the top of a bag mouth and retained behind the longitudinal slot in the hollow handle, said slot being formed by the open portion of the c-shaped cross section; thereby attaching the closure structure to the bag mouth.

18. A device according to claim 11 further including ties secured to the hollow handle which assist in attaching the closure structure to a bag mouth.

19. A device according to claim 11 further including a shoulder strap formed of an additional loop of material that is laced through the hollow handle, said loop of material being seperate and unconnected to the flexible portion of the semirigid drawstring.

20. A device according to claim 11 further including a shoulder strap formed of an additional loop of material that is seperate and unconnected to the drawstring; said loop of material is laced through the hollow handle and is adapted to being threaded through openings in the fold in the top of a bag mouth at the ends of the hollow handle.

* * * * *